US006511166B2

(12) United States Patent
Smith et al.

(10) Patent No.: US 6,511,166 B2
(45) **Date of Patent: *Jan. 28, 2003**

(54) LONG-LIFE SPRING-BACKED FLUID INTERCONNECT SEAL

(75) Inventors: Mark A. Smith, Corvallis, OR (US); Peter R. Stokes, Monroe, OR (US); Jeffrey F. Bell, Corvallis, OR (US); John L. Taylor, Corvallis, OR (US); Daniel W. Petersen, Philomath, OR (US); David R. Otis, Jr., Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/025,058

(22) Filed: Dec. 19, 2001

(65) Prior Publication Data

US 2002/0093554 A1 Jul. 18, 2002

Related U.S. Application Data

(63) Continuation-in-part of application No. 09/651,682, filed on Aug. 30, 2000, now Pat. No. 6,361,157.

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS

| | | | | |
|---|---|---|---|---|
| 5,905,518 A | | 5/1999 | DeFilippis | 347/85 |
| 6,033,064 A | | 3/2000 | Pawlowski, Jr. et al. | 347/87 |
| 6,361,157 B1 | * | 3/2002 | Petersen et al. | 347/85 |

* cited by examiner

*Primary Examiner*—Anh T. N. Vo
(74) *Attorney, Agent, or Firm*—Larry D. Baker

(57) ABSTRACT

An ink jet printing apparatus that includes a springbacked fluid interconnect seal that provides a seal between an ink handling component and an ink pipe that is attached to the ink handling component. The spring-backed fluid interconnection seal more particularly includes a generally conically tapered resilient seal, and a pre-loaded spring configured to axially extend or tension the seal. An exemplary embodiment of the invention includes a groove in the sealing face which allows the use of a liquid sealant. The groove holds the sealant in place through capillary forces, and also by virtue of trough-like shape protects the sealant from being wiped away through mechanical member.

24 Claims, 2 Drawing Sheets

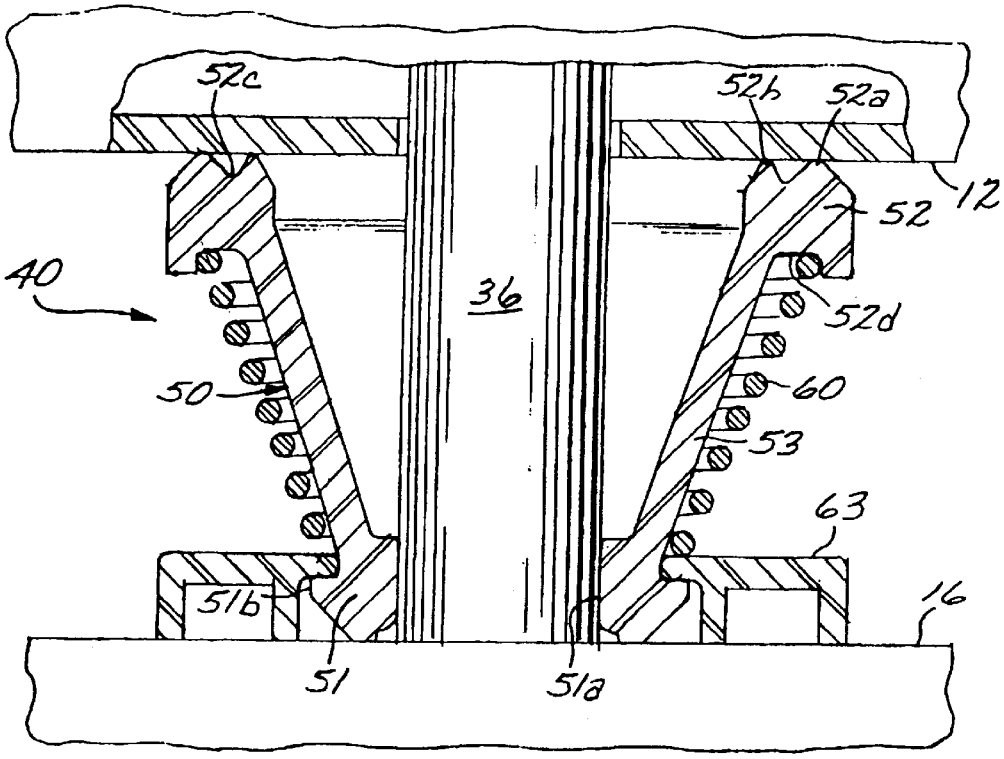
FIG. 3
FIG. 4
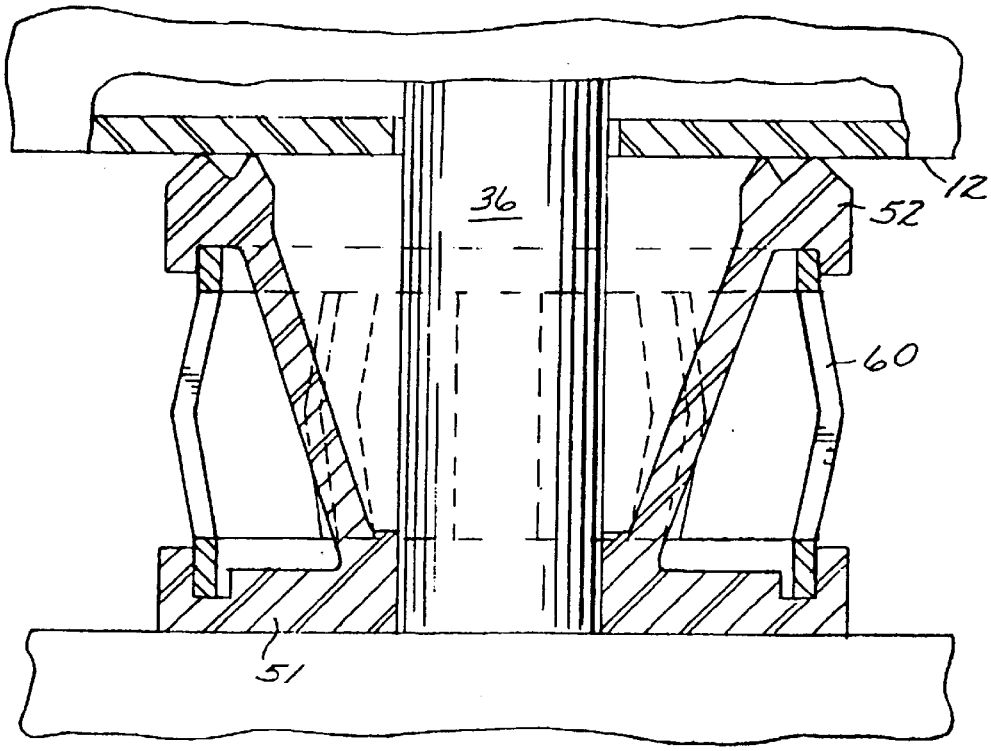

LONG-LIFE SPRING-BACKED FLUID INTERCONNECT SEAL

RELATED APPLICATION

This application is a continuation-in-part of U.S. application Ser. No. 09/651,682 entitled "Long-Life Spring-Backed Fluid Interconnect Seal" filed Aug. 30, 2000 now U.S. Pat. No. 6,361,157.

BACKGROUND OF THE INVENTION

The present invention relates to ink delivery systems for supplying ink to an ink jet printhead of an ink jet printing apparatus, and more particularly to a springbacked seal for a fluid interconnect between ink-containing components of an ink delivery system.

Ink jet printers commonly employ an ink jet printhead cartridge that includes an ink jet printhead supported by a print carriage that is moved relative to a print medium, such as paper. As the printhead and their print medium are moved relative to each other, a control system activates the printhead to deposit or emit ink droplets onto the print medium to form a printed image. Ink is provided to the printhead, for example, from an ink reservoir that is integral with the printhead cartridge, or from an ink reservoir that is replaceable separately from the printhead cartridge.

A consideration with a printing system that makes use of an ink reservoir that is replaceable separately from the printhead cartridge is the need for a reliable fluidic interconnection seal between the ink reservoir and the printhead cartridge that reduces evaporation of water and other volatile ink components, minimizes air transfer into the ink delivery system, and is robust against contamination. The seal should also remain effective despite minor imperfections of the sealing surface.

SUMMARY OF THE INVENTION

The disclosed invention is directed to an ink delivery system for an ink jet printer that includes a spring-backed sealing structure for providing a seal between an ink handling component and an ink pipe. The spring-back seal more particularly includes a circumferential resilient seal formed of a conically tapered seal body having first and second annular sealing collars at respective end openings of the seal body, and a pre-loaded compression spring configured to axially urge one of the sealing collars against the ink handling component which can comprise a replaceable ink container. An exemplary embodiment of the invention includes a groove in the sealing face which allows the use of a liquid sealant. The groove holds the sealant in place through capillary forces, and also by virtue of its trough-like shape protects the sealant from being wiped away through mechanical means.

BRIEF DESCRIPTION OF THE DRAWINGS

The advantages and features of the disclosed invention will readily be appreciated by persons skilled in the art from the following detailed description when read in conjunction with the drawing wherein:

FIG. 3 is a schematic cross-sectional view illustrating a spring-backed sealing structure in accordance with the invention.

FIG. 4 is a schematic cross-sectional view illustrating a further spring-backed sealing structure in accordance with the invention.

DETAILED DESCRIPTION OF THE DISCLOSURE

Figure 1:
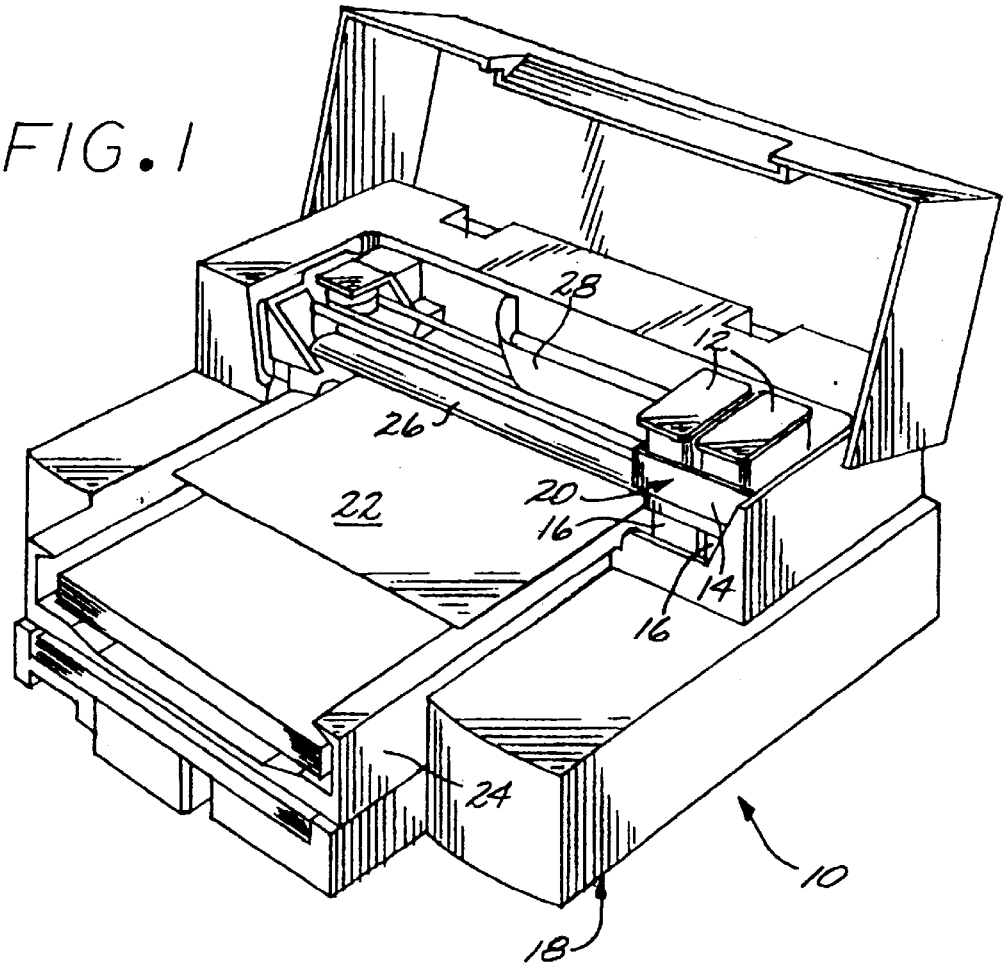
FIG. 1 is one exemplary embodiment of an ink jet printing system of the present invention shown with a cover opened to show a plurality of replaceable, ink containers of the present invention.

In the following detailed description and in the several figures of the drawing, like elements are identified with like reference numerals.

FIG. 1 is a perspective view of an exemplary embodiment of a printing system 10 shown with its cover open, that includes at least one replaceable ink container 12 that is installed in a receiving station 14. With the replaceable ink container 12 properly installed into the receiving portion 14, ink is provided from the replaceable ink container 12 to at least one ink jet print cartridge 16. The ink jet print cartridge 16 includes a small ink reservoir and an ink jet printhead 17 (FIG. 2) that is responsive to activation signals from a printer portion 18 to deposit ink on print media. As ink is ejected from the printhead 17, the print cartridge 16 is replenished with ink from the ink container 12. In an illustrative embodiment, the replaceable ink container 12, receiving 20 station 14, and ink jet printhead cartridge 16 are each part of a scanning print carriage 20 that is moved relative to a print media 22 to accomplish printing. The printer portion 18 includes a media tray for receiving the print media 22. As the print media 22 is stepped through a print zone, the scanning carriage 20 moves the print cartridge 16 relative to the print media 22. The printer portion 18 selectively activates the printhead 17 to deposit ink on print media 22 to thereby accomplish printing.

The scanning carriage 20 is moved through the print zone on a scanning mechanism which includes a slider rod 26 on which the scanning carriage 20 slides as the scanning carriage 20 moves along a carriage scan axis. A positioning mechanism (not shown) is used for precisely positioning the scanning carriage 20. In addition, a paper advance mechanism (not shown) is used to step the print media 22 through the print zone as the scanning carriage 20 is moved along the carriage scan axis. Electrical signals are provided to the scanning carriage 20 for selectively activating the printhead 16 by means of an electrical link such as a ribbon cable 28.

Figure 2:
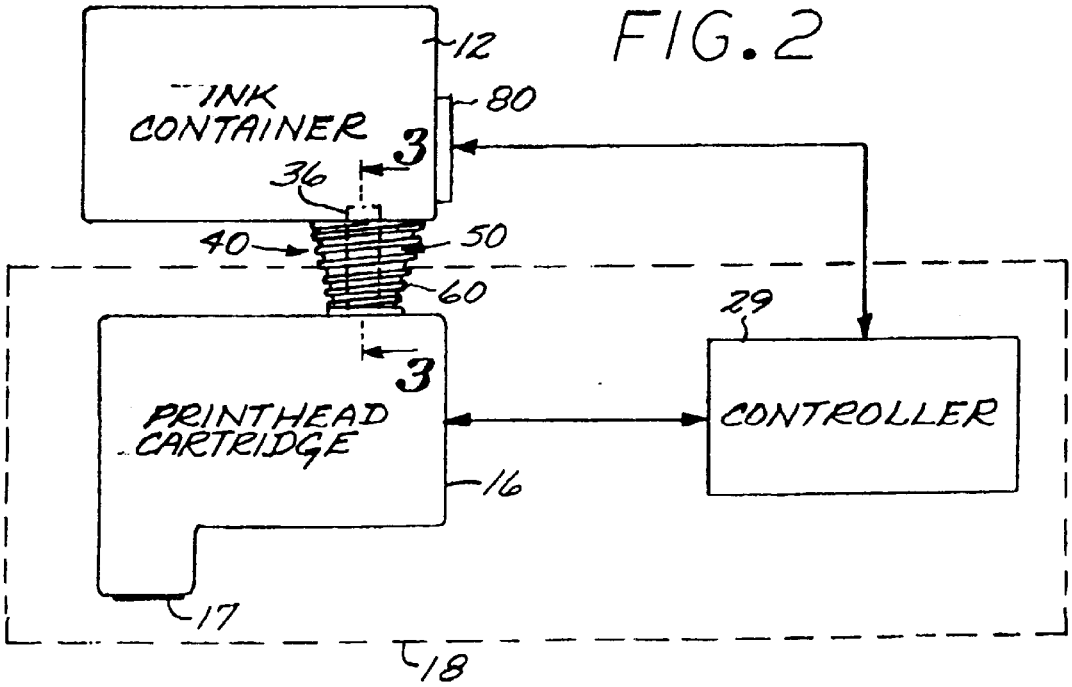
FIG. 2 is a schematic representation of the inkjet printing system shown in FIG. 1.

FIG. 2 is a simplified schematic representation of the inkjet printing system 10 of FIG. 1 that illustrates the use the disclosed fluid interconnect seal between a printhead cartridge 16 and an ink container 12. FIG. 2 is simplified to illustrate a single printhead 16 connected to a single ink container 12. The ink jet printing system 10 includes the printer portion 18 and the ink container 12, which is configured to be received by the printer portion 18. The printer portion 18 includes the inkjet printhead 16 and a controller 29. With the ink container 12 properly inserted into the printer portion 18, an electrical and fluidic coupling is established between the ink container 12 and the printer portion 18. The fluidic coupling allows ink stored within the ink container 12 to be provided to the printhead 16. The electrical coupling allows information to be passed between an electrical storage device 80 disposed on the ink container 12 and the printer portion 18. The exchange of information between the ink container 12 and the printer portion 18 is to ensure the operation of the printer portion 18 is compatible with the ink contained within the replaceable ink container 12, thereby achieving high print quality and reliable operation of the printing system 10.

The controller 29, among other things, controls the transfer of information between the printer portion 18 and the replaceable ink container 12. In addition, the controller 29 controls the transfer of information between the printhead cartridge 16 and the controller 29 for activating the printhead 17 to selectively deposit ink on print media. In addition, the controller 29 controls the relative movement of the printhead 16 and print media. The controller 29 performs additional functions such as controlling the transfer of information between the printing system 10 and a host device such as a host computer (not shown).

The replaceable ink container 12 is more particularly fluidically connected to the printhead cartridge 16 by an upstanding ink pipe or conduit 36 that extends upwardly into the ink container 12 and downwardly into the ink jet print cartridge 16. By way of illustrative example, the ink pipe 36 is fixedly attached to the printhead cartridge 16, and is removably disposed in the replaceable ink container, so that the ink container 12 can be selectively attached to and detached from the ink pipe 36. Fluid sealing structures can be provided at the ends of the ink tube, and an external fluid interconnect sealing structure 40 is provided as a water vapor and air barrier to reduce evaporation of volatile ink components such as water, to minimize air transfer into the ink handling components, and to minimize contamination.

As illustrated in FIG. 3, the fluid interconnect sealing structure 40 more particularly includes a generally circumferential resilient seal 50 and a pre-loaded compression spring 60 that assists to axially extendingly urge the resilient seal 50 when the sealing structure is appropriately installed. The resilient seal 50 more particularly includes a generally conically tapered seal body 53 having an axial extent and a circular cross-section orthogonally to such axial extent. First and second annular sealing collars 51, 52 are disposed at respective end openings of the seal body 53.

The first sealing collar 51 includes an inner radial sealing surface 51*a* that engages the ink pipe 36 and applies a radial sealing force to the ink pipe, and an outer tapered flange or barb-like feature 51*b* that engages a retaining ring 63 mounted on the print cartridge 16.

The second sealing collar 52 includes an annular axial sealing surface comprised of a plurality of radially concentric, axially extending annular sealing rims or lips 52*a*, 52*b* that are separated by a sealing lubricant retaining annular groove 52*c*. The second sealing collar 52 further includes an outer spring retaining pocket or groove 52*d* for retaining one end of the spring 60 which by way of example surrounds the seal body 53. The other end of the spring 60 rests, for example, against the retaining ring 63 of the print cartridge 16.

The sealing lubricant retaining annular groove 52*c* allows the use of a liquid sealant to provide an improved air-tight seal. The annular groove 52*c* not only holds the sealant in place through capillary forces, but also by virtue of its trough-like shape protects the sealant from being wiped away through mechanical means. The groove of an exemplary embodiment is approximately 0.5 mm deep with an included angle of 75 degrees, although other depths and angular configurations are possible. Sealant is dispensed into this groove, which acts like a capillary reservoir. The liquid sealant is available to be drawn into the smaller capillaries formed by contaminants or other surface asperities at the seal lip (not illustrated).

The seal body 53 and the first and second annular sealing collars 51, 52 preferably comprise a resilient 15 integral elastomeric structure comprising for example an Ethylene-Propylene-Diene monomer/butyl blend (EPDM/butyl), and different portions of the seal 50 can be formed of different elastomers.

The sealing structure 40 is dimensioned such that the resilient seal 50 and the spring 60 are axially compressed when the replaceable ink container 12 is properly connected to the ink pipe 36. In this manner, the sealing lips 52*a*, 52*b* of the second sealing collar 52 are axially urged against a flat surface disposed on the lower surface of the replaceable ink container 12, and the sealing structure 40 thus provides a seal between the ink container 12 and the ink tube 36. In other words, the sealing structure 40 sealingly encloses a region 49 between the replaceable ink container 12 and the ink tube 36, and thus provides a seal 30 between the replaceable ink container 12 and the ink tube 36.

The compression spring 60 is more particularly dimensioned to function as an expansion spring when the sealing structure is retained by the retaining ring 63 of the printhead cartridge 16, and thus axially, expandingly pre-loads or tensions the seal 50 so that the seal 50 will return to its non-deformed axial length when compressive forces are removed from the sealing structure. Stated yet another way, since the retaining barb-like feature 51*b* of the first sealing collar 51 is pulled against the retaining ring 63 when the sealing structure 40 is installed in the retaining ring 63, the spring 60 axially urges the sealing collars 51, 52 away from each other.

By way of illustrative example, the spring 60 comprises a tapered coil spring that generally follows the contour of the conically tapered seal body. The spring 60 can also comprise another suitable spring structure such as a leaf spring structure illustrated in FIG. 4 which includes a plurality of spring leaves that extend axially and are interconnected at their ends. The first sealing collar 51 of the sealing structure of FIG. 4 extends outward radially to capture the lower portion of the leaf spring structure 60. Generally, the disclosed sealing structure contemplates some form of axially expanding spring structure.

The foregoing has thus been a disclosure of an ink jet printing system that employs a spring-backed fluid interconnect seal that advantageously provides a consistent seal pressure over a range of compression conditions and over a long life, and allows the use of materials for the resilient seal portion that have low permeability to air and water vapor but have less than optimal compression and stress relaxation properties.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. An ink delivery system for an ink jet printer, comprising:

a first ink handling component;

a second ink handling component;

an ink pipe interconnected between said first ink handling component and said second ink handling component;

a spring-backed sealing structure for providing a seal between said first ink handling component and said ink pipe;

said spring-backed sealing structure including:

a seal comprising a seal body having a circular cross-section and axial extent, a sealing collar disposed at an end of said seal body, the sealing collar having a grooved annular sealing surface for engaging said first ink handling component, the grooved sealing surface configured to retain a sealing fluid by capillary action; and a spring configured to axially expand said seal.

2. The ink delivery system of claim 1 wherein said spring comprises a compression spring.

3. The ink delivery system of claim 2 wherein said compression spring comprises a coil spring.

4. The ink delivery system of claim 3 wherein said coil spring comprises a tapered coil spring.

5. The ink delivery system of claim 2 wherein said compression spring comprises a leaf spring.

6. The ink delivery system of claim 1 wherein said seal body is conically tapered.

7. The ink delivery system of claim 1 wherein said sealing collar includes a radial sealing surface for engaging said ink pipe.

8. The ink delivery system of claim 1 wherein said seal body and said sealing collar comprise an integral structure formed of an elastomer.

9. The ink delivery system of claim 1 wherein said spring-backed interconnect seal is axially compressed between said first ink handling component and said second ink handling component.

10. The ink delivery system of claim 1 wherein the grooved annular sealing surface has a groove with a substantially triangular cross section.

11. The ink delivery system of claim 10 wherein the groove is less than 1.0 mm deep.

12. The ink delivery system of claim 10 wherein the groove has an included angle of about 75 degrees.

13. An ink delivery system for an ink jet printer, comprising:

a first ink handling component;

a second ink handling component;

an ink pipe interconnected between said first ink handling component and said second ink handling component;

a spring-backed sealing structure for providing a seal between said first ink handling component and said ink pipe;

said spring-backed sealing structure including:

a seal comprised of a seal body having a circular cross-section and axial extent, the seal having a first sealing collar disposed at a first end of said seal body, and a second sealing collar disposed at a second end of said seal body, the first sealing collar having a grooved annular sealing surface for engaging said first ink handling component, the grooved sealing surface configured to retain a sealing fluid by capillary action; and a spring configured to axially expand said seal.

14. The ink delivery system of claim 13 wherein said spring comprises a compression spring.

15. The ink delivery system of claim 14 wherein said compression spring comprises a coil spring.

16. The ink delivery system of claim 15 wherein said coil spring comprises a tapered coil spring.

17. The ink delivery system of claim 14 wherein said compression spring comprises a leaf spring.

18. The ink delivery system of claim 13 wherein said seal body is conically tapered.

19. The ink delivery system of claim 13 wherein said seal body, said first sealing collar and said second sealing collar comprise an integral structure formed of an elastomer.

20. The ink delivery system of claim 13 wherein said spring-backed interconnect seal is axially compressed between said first ink handling component and said second ink handling component.

21. The ink delivery system of claim 13 wherein said first ink handling component is a replaceable ink container.

22. The ink delivery system of claim 13 wherein the grooved annular sealing surface has a groove with a substantially triangular cross section.

23. The ink delivery system of claim 22 wherein the groove is less than 1.0 mm deep.

24. The ink delivery system of claim 22 wherein the groove has an included angle of about 75 degrees.

* * * * *